United States Patent [19]

Watson

[11] 4,291,761

[45] Sep. 29, 1981

[54] MAGNETIC SENSING DEVICE

[75] Inventor: Willie L. Watson, Fredericksburg, Ohio

[73] Assignee: Multi Products Co., Millersburg, Ohio

[21] Appl. No.: 142,374

[22] Filed: Apr. 18, 1980

[51] Int. Cl.[3] ..... H01H 36/00

[52] U.S. Cl. ..... 166/66; 166/65 M; 200/84 C; 335/207; 340/623

[58] Field of Search ..... 166/66, 65 M, 53; 200/84 C; 340/623, 540; 417/58, 56, 57, 59; 335/205, 207

[56] References Cited

U.S. PATENT DOCUMENTS

| | | | |
|---|---|---|---|
| 3,012,512 | 12/1961 | Shaw | 417/57 |
| 3,031,971 | 5/1962 | Roach | 417/57 |
| 3,053,188 | 9/1962 | Dinning et al. | 417/56 |
| 3,389,603 | 6/1968 | Jacobs | 200/84 C |
| 3,691,470 | 9/1972 | Ragni | 335/207 |
| 3,852,692 | 12/1974 | Moorman | 335/207 |
| 4,075,588 | 2/1978 | Verger | 335/207 |
| 4,090,050 | 5/1978 | Siliberg | 340/623 |

*Primary Examiner*—William F. Pate, III
*Attorney, Agent, or Firm*—Harvey B. Jacobson

[57] ABSTRACT

A magnetic sensing device for sensing the proximity of a gas lift plunger up from the bottom of an oil or gas producing well is used to initiate the off cycle of the well and which comprises only one moving component, a magnet which is attracted to the plunger, completing an electrical circuit to a unit for controlling the operation of the well. The magnet is returned to its resting position by a ferrous set screw adjacent the magnet which attracts the magnet once the gas lift plunger has passed the field of the magnet sensor. The magnet and electrical contacts for the sensing device are enclosed in a molded plastic housing which can be easily opened to repair or replace any worn components.

10 Claims, 4 Drawing Figures

40
28
36
30
22
34
17
20
10
18
14
32
12
24
16
26

12
38
34
17
74
72
76
29

52
46
56
48
66
42
58
44
50
54

12
34
36
68
46
44
78
52
82
56
24
60
66
25
62
58
17
54
72
50
48
42
80
29
70
38

MAGNETIC SENSING DEVICE

BACKGROUND OF THE INVENTION

Field of the Invention

The present invention relates to a control system for a well, producing oil and gas by the gas lift plunger method, wherein a plunger or "rabbit" lifts all the fluids (oil, gas and water) out of the well tubing by the application of pressurized gas underneath the "rabbit" from the oil formation or from the well casing.

The standard operating procedure to produce gas or oil from wells utilizing a gas lift plunger comprises operating on a specifically designated timed on and off cycle. During the off cycle, the well is in an idle position storing the oil and gas and other fluids above the "rabbit" or plunger. Once the designated time for the duration of the off cycle is reached, the controller actuated by the timing device opens a master flow valve which increases the gas pressure underneath the plunger by increasing the gas flow from the earthen formation or from gas supplied through the well casing to provide upward movement of the plunger through the well tubing. The upward movement of the plunger pushes all of the oil or other fluids in the tubing which have accumulated above the plunger to the top of the well. While the well is operated on the on cycle, the plunger continues pushing the oil or other fluids up through and out of the well tubing. When the tubing reaches the off position, which time has been preset, the gas flow underneath the plunger is terminated, along with the upward movement of the plunger and the production of oil and gas from the well. The presetting of on and off cycle duration times often results in inefficient oil production, as the time it takes for the plunger to reach the top of the well is varied depending upon the amount and viscosity of the oil or other fluids pushed up the well. In some instances, the plunger has not reached the top of the well when the preset time for the on cycle has ended, and in other instances the plunger has reached the top of the well before the on cycle is over. Besides timing devices, pressure sensing devices have also been used to initiate the on and off cycle of wells operated by the gas lift plunger method.

The present invention provides for a device which senses the proximity of the "rabbit" at the top of the well, which device is utilized to trigger the control mechanism to initiate the off cycle. Since the off cycle is initiated only when the "rabbit" has reached the top of the well, all the oil or other fluids which have been collected from the formation are brought to the top of the well and collected. The sensing device enables the efficient production of oil wells, significantly reducing the amount of waste gas used to drive the plunger or "rabbit" up the well tubing.

Disclosure Statement

The present invention is directed to a magnetic sensing device which senses the proximity of a ferrous containing object. As the object enters the magnetic field of the sensing device, the housing containing the magnet is moved to complete an electrical circuit to a timer controller, thus initiating the control function. Examples of patented magnetic proximity sensing apparatus are U.S. Pat. No. 4,071,725, issued Jan. 31, 1978 to Smith et al., and U.S. Pat. No. 4,168,413, issued Sept. 18, 1979 to Halpine, both of which disclose proximity sensing devices which require the movement of several components to actuate an electric control device. U.S. Pat. No. 3,022,398 also discloses an electric control device which is actuated by a magnetic proximity sensor. The sensing device of this patent is typical of the state of the art in which spring pressure is used to oppose an attracting magnetic field, the spring returning the actuated components to the normal or off position once the proximal magnetic flux has been removed. Magnetic sensing devices used to sense fluid levels have also been patented in which floatable magnetic means actuate liquid level control devices. Examples of such patents are U.S. Pat. No. 4,103,265, issued July 25, 1978; U.S. Pat. No. 3,823,328, issued July 9, 1974; U.S. Pat. No. 3,404,809, issued Oct. 8, 1968; and U.S. Pat. No. 3,389,603, issued June 25, 1968. A magnetically actuated well working tool is disclosed in U.S. Pat. No. 3,105,550, issued Oct. 1, 1963 to Ehlert, in which a series of subsurface signalling stations, each providing a distinctively different signal, produces the specific work task of the tool.

SUMMARY OF THE INVENTION

The magnetic proximity sensing device of the present invention overcomes the problems associated with wells producing oil and gas by the gas lift plunger method in which a timer controlled on and off cycle is standard operation. By continuing the on cycle of the well unit all of the oil or other fluids which have been stored in the well tubing above the plunger are pushed to the top, the well can produce the oil or gas in an efficient manner.

The present invention provides for a magnetic proximity sensing device which can be easily mounted at the top of the well head for sensing the return of the plunger to the top of the well. The "on" or oil producing cycle of the well is continued until the plunger is sensed.

Problems, such as the need to continuously replace worn or broken components, associated with prior art magnetic sensing devices which use spring biased members for effecting contact and which use a plurality of moving components to complete an electric circuit are overcome by the present invention which utilizes a single moving part. The magnetic sensing device of the present invention comprises a magnet pressed into a magnet housing which is surrounded by a conductive metal washer, the housing being drawn by the magnet toward the plunger or "rabbit" which passes through the magnetic field of the device, the washer member completing the circuit between two separate electrical contact points. Only a very small movement of the washer engaging member is necessary to complete the electric circuit and initiate operation of the well on-off controller. Once the plunger has passed through the magnetic field of the sensing device, a ferrous set screw adjacent the magnet pulls the magnet and associated housing back to its resting position, thus eliminating the need for bias springs to regulate the movement of the engaging or circuit completing members. The magnet and magnet housing are themselves enclosed in a molded plastic housing which can be easily removed from the well tubing structure and opened to replace any worn or damaged parts. This is an improvement over prior art sensing devices which were enclosed in welded housings.

Accordingly, it is an object of the present invention to provide a magnetic proximity sensing device to control the operation of a well, producing oil by the gas lift plunger method.

It is another object of the present invention to provide a magnetic proximity sensing device to sense the gas lift plunger at the top of an oil-producing well to complete the production cycle of the well.

It is a further object of the invention to provide a magnetic proximity sensing device for completing an electrical circuit which includes only one moving component.

It is still another object of the present invention to provide a magnetic proximity sensing device in which a magnetic means is moved to complete an electric circuit, and is reset to its resting position by a magnetically attracting means.

It is still yet another object to provide a magnetic sensing device for completing an electrical circuit in which the magnet housing and electrical contacts are enclosed within an easy-to-open moldable plastic housing for the easy replacement of worn or damaged components.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
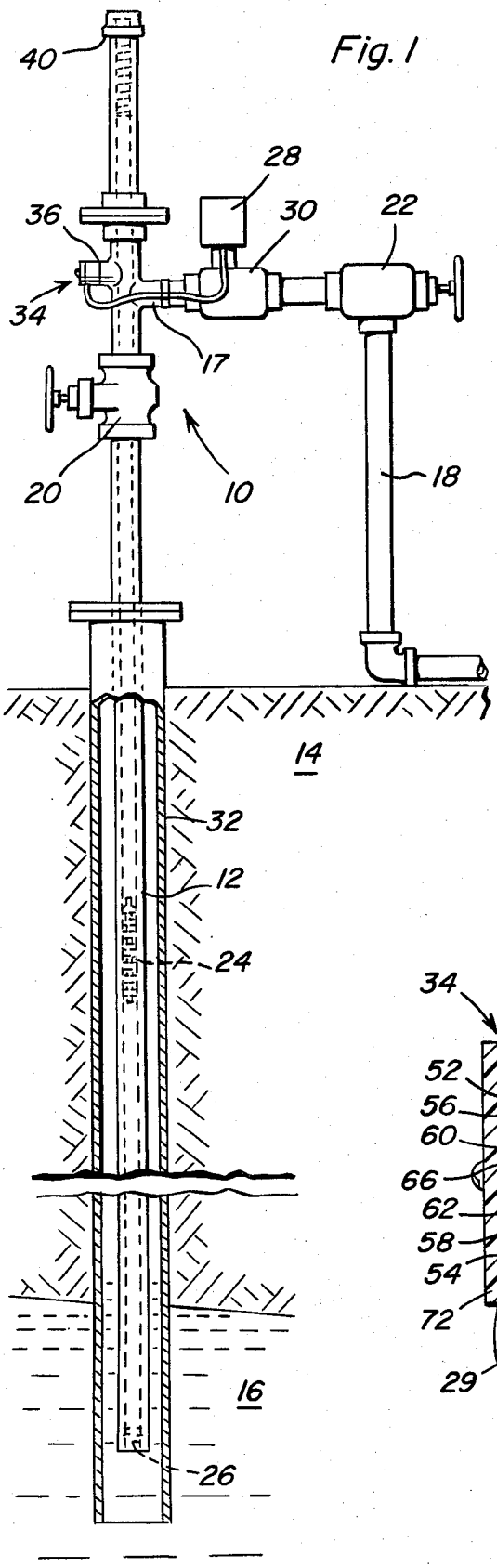
FIG. 1 is a schematic illustration, partly in elevation and section, of an oil-producing well operated by the gas lift plunger method which includes the magnetic proximity sensing device of the present invention.

A well used for the production of oil or gas and being operated by the gas lift plunger method is designated by the numeral 10 in FIG. 1. Well 10 includes tubing 12 placed through subsurface 14 and into contact with oil reservoir 16. Tubing 12 is connected above the ground surface to the oil and gas collection pipe lines 17 and 18 for collection, refining or sale. Valves 20 and 22 are used to control the flow of oil brought to the top of the well from oil reservoir 16. Within the tubing 12 is gas lift plunger or "rabbit" 24 which is used to lift the oil, gas or other fluids from oil reservoir 16 to the top of the well and through pipe lines 17 and 18. Plunger 24 is shown as a cylindrical plug containing spaced circumferential extensions 25 about a central body through other shapes can be and are conventionally utilized.

During the off cycle of well 10, plunger 24 rests on plunger seat 26 at the bottom of tubing 12. The on-off cycle for well 10 is regulated by timer controller 28 placed at the top of the well which operates motor valve 30 to provide a flow of pressurized gas through well casing 32 underneath plunger 24, thus causing plunger 24 to be pushed up through tubing 12, the plunger itself pushing the oil which has accumulated by percolation between the sides of tubing 12 and extensions 25 above plunger 24 while it is seated at the bottom of the well.

Figure 2:
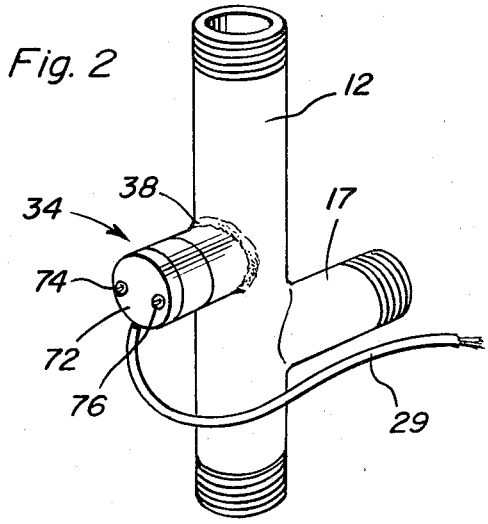
FIG. 2 is a perspective view illustrating the magnetic sensing device of the present invention and its placement and connection to the tubing at the top of the oil-producing well.

The magnetic proximity sensing device of the present invention is used in place of the standard timer controller which presets the duration of both the on cycle and off cycle of well 10. The magnetic sensing device of the present invention is designated by numeral 34 and is secured to well 10 by a steel housing 36 welded to tubing 12 by continuous weldment 38, as shown in FIG. 2. In operation, timer control 28, after a preset duration of time elapses for the off cycle in which oil from reservoir 16 percolates above plunger 24 resting on plunger seat 26, initiates the on cycle in which pressurized gas through casing 32 pushes plunger 24 and the oil or other fluids ahead of the plunger up to the top of the well. Oil and other fluids reaching the top of the well are conveyed to pipe lines 17 and 18. Plunger 24 continues up the well tubing 12 and past magnetic proximity sensing device 34 which senses the plunger and responds to the proximity of plunger 24, completing an electrical circuit to activate timer control 28 through electrical connection 29 to initiate the off cycle of well 10, at which time the oil storing cycle begins again, the plunger 24 descending down tubing 12 to plunger seat 26 due to gravity and oil in reservoir 16 percolating up through the tubing 12.

Figure 3:
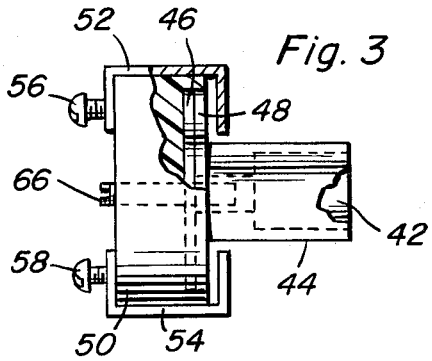
FIG. 3 is a side elevational view partly broken away of the magnetic proximity sensing device of the present invention, the magnet and the magnet housing being in the resting position.
Figure 4:
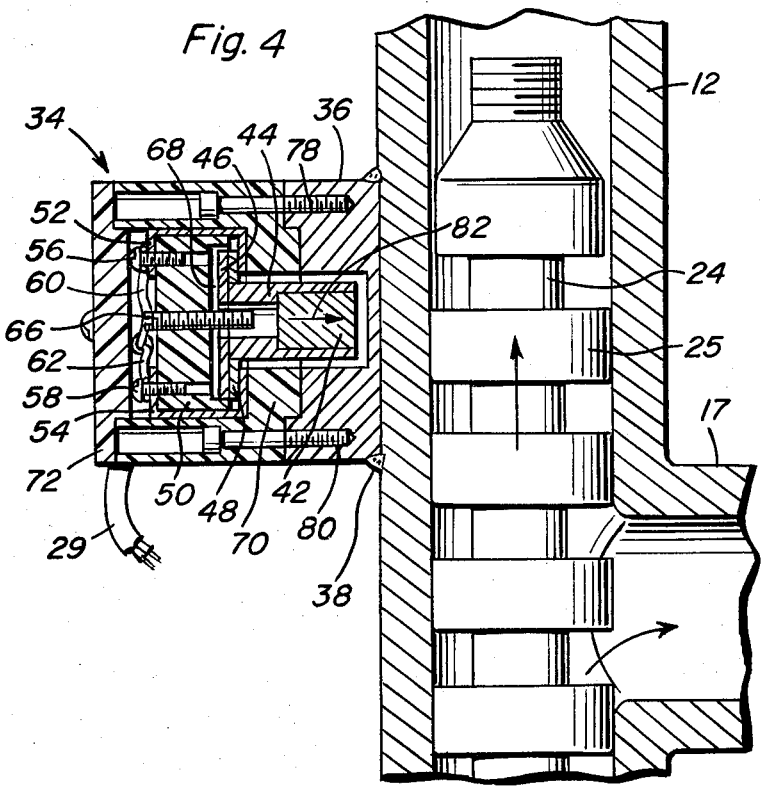
FIG. 4 is a sectional view illustrating the movement of the gas lift plunger in the field of the magnetic sensing device, the movement of the magnet and magnet housing, plunger and oil and gas being shown by the appropriate arrows.

FIGS. 3 and 4 show magnetic proximity sensing device 34 of the present invention in the resting and responding positions, respectively. Magnet 42, such as a rare earth magnet, is pressed into housing 44 formed of metal or plastic and which includes flange or head 46 placed at the end of housing 44 opposite the end containing magnet 42. Placed adjacent flange 46 is an electrically conductive metal washer such as stainless steel washer 48 which is placed over housing 44 and can be attached to flange or head 46 by an adhesive. A nonconductive connecter disc 50 includes two spaced conductive clip contacts 52 and 54 secured on opposite sides thereof. The conductive clips are held into place by screws 56 and 58 which hold wire leads 60 and 62 against the metal contacts 52 and 54, respectively. Iron-containing set screw 66 is placed through connector disc 50, through housing flange 46 and adjacent magnet 42. Set screw 66 holds magnet 42 and the associated magnet housing 44 in seat 68 formed in connecter disc 50, so that conductive washer 48 is not in contact with clips 52 and 54.

Magnet housing 44 and connector disc 50 are enclosed within molded plastic housing 70 which includes a top 72 secured to housing 70 by means of screws 74 and 76, as shown in FIG. 2. Plastic housing 70 is secured to steel housing 36 by means of screws 78 and 80. A preferred material for forming plastic housing 70 is an acetal resin under the trade name "Delrin" which has a known use for forming pipes and pipe fittings and can be easily injection-molded and extruded into the proper shape.

In operation, as plunger 24 reaches the top of the well, pushing the oil and other fluids to pipe connection 17, it passes through the magnetic field formed by magnet 42. Plunger 24, containing or formed from ferrous materials attracts magnet 42 in the direction of arrow 82, pulling magnet housing 44, flange 46 and attached conductive washer 48 to the right, thus producing contact between washer 48 and clip contacts 52 and 54, completing the electric circuit formed by leads 60 and 62 of wire 29. The completed circuit sends an impluse to timer control 28, initiating the off cycle of well 10. Once plunger 24 is out of the magnetic field of magnet 42 and situated in "rabbit catcher" 40, magnet 42 is again attracted to set screw 66 which is positioned adjacent magnet 42 to pull the magnet toward its resting position. The distance between set screw 66 and magnet 42 is adjusted according to the magnet attracting properties of plunger 24 and the distance between plunger 24 and the magnet 42, plunger 24 pulling magnet 42 away from the attracting field of set screw 66. Only a very slight movement of magnet 24 toward plunger 44 is needed to complete the circuit.

The "Delrin" plastic housing 70 and associated top cover 72 is an improvement over prior art sensing devices which have been enclosed in stainless steel welded housings. Any worn or damaged components of magnetic proximity sensing device 34 which have to be replaced are easily substituted by removing top 72 from housing 70 and, if needed, removing housing 70 from connecting housing 36 by means of the aforementioned attachment screws. Housing 70 greatly reduces the down time needed for replacement of in operative components.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. A magnetic proximity sensing device comprising; a movable magnet for sensing the proximity of an iron-containing object crossing the magnetic field of the magnet, a housing to secure said magnet and being movable therewith, said housing including an electrically conductive portion, said device including a means spaced from said electrically conductive portion capable of forming a complete electrical circuit when in contact with said electrical conductive portion, said magnet housing being movable so that said electrically conductive portion can engage said means to form said electrical circuit, and an adjustment means adjacent said magnet capable of maintaining said magnet housing at a location whereby said electrically conductive portion is out of contact with said means to complete said electrical circuit when said iron-containing object is not in the magnetic field of said magnet, said adjustment means being a magnetic set screw positioned adjacent said magnet, the position of said set screw relative to said magnet being able to be adjusted by turning said screw and thereby magnetically attracting said magnet.

2. The device of claim 1 wherein said set screw and said means to complete an electrical circuit are secured to a holding means adjacent said magnet housing.

3. The device of claim 2 wherein said means able to complete an electric circuit comprises two electrically conductive clips placed on opposite sides of said holding means and out of engagement with each other and said electrically conductive portion is a washer placed around said magnet housing.

4. The device of claim 3 wherein said clips include a portion spaced from said holding means and said magnet housing is movable toward said holding means out of contact with said spaced portions and away from said holding means in contact with said spaced portions.

5. The device of claim 4 wherein said magnet housing and said holding means are enclosed within a plastic housing, said plastic housing including a end portion removably attached to the body of said plastic housing.

6. The device of claim 5 wherein said magnet and attached magnet housing is the only moving part of said device.

7. In a well used to produce oil or gas and comprising a subterranean tubing open to said oil or gas and an annular casing surrounding said tubing, a plunger positioned within said tubing and means to initiate movement of the plunger up the tubing and for initiating the end of said upward movement, said means being a preset time controller, the improvement comprising a magnetic proximity sensing device placed near the top of the well tubing to sense the plunger as it reaches the top of the well and passes through the magnetic field of the sensing device and means it initiate the end of said upward movement in response to said sensing device, said sensing device including a magnet secured in a movable magnet housing, said magnet housing including an electrically conductive portion, an electrically conductive means able to complete an electric circuit when in contact with said electrically conductive portion, said magnet housing being movable so that said electrically conductive portion can engage said electrically conductive means when said plunger passes through the magnetic field of the sensing device, means to magnetically attract said magnet to maintain said electrically conductive portion at a spaced location from said electrical conductive means when said plunger does not pass through said magnetic field, said magnetically attracting means capable of being adjusted to vary the magnetic field attracting said magnet.

8. The oil producing well of claim 7 wherein said magnet housing is enclosed by a plastic housing which is removably secured to a housing welded to said well tubing.

9. A magnetic proximity sensing device comprising: a pair of separate electrically conductive means capable of forming a complete electrical circuit when in contact with each other, a movable magnet for sensing the proximity of an iron-containing object crossing the magnetic field of the magnet, at least one of said electrically conductive means associated with said magnet and movable therewith, said magnet movable from a position in which said pair of electrically conductive means are not in contact to a position whereby said electrically conductive means are in contact to complete an electrical circuit, said magnet movable to one of said positions by the proximity of said iron-containing object crossing the magnetic field of said magnet and to the other of said positions by a separate magnetically attracting means capable of being adjusted to vary the magnetic field attracting said magnet to said other position.

10. The device of claim 9 wherein said magnetically attracting means is a magnetic set screw positioned adjacent said magnet, the position of said set screw relative to said magnet being able to be adjusted by turning said screw and determining the magnetic field attracting said magnet.

* * * * *